US008387204B2

(12) United States Patent
Dyson

(10) Patent No.: US 8,387,204 B2
(45) Date of Patent: Mar. 5, 2013

(54) HANDHELD CLEANING APPLIANCE

(75) Inventor: James Dyson, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 889 days.

(21) Appl. No.: 12/307,118

(22) PCT Filed: Jul. 6, 2007

(86) PCT No.: PCT/GB2007/002540

§ 371 (c)(1),
(2), (4) Date: Jul. 28, 2009

(87) PCT Pub. No.: WO2008/009890

PCT Pub. Date: Jan. 24, 2008

(65) Prior Publication Data

US 2009/0307864 A1 Dec. 17, 2009

(30) Foreign Application Priority Data

Jul. 18, 2006 (GB) ..... 0614235.0
Sep. 20, 2006 (GB) ..... 0618492.3

(51) Int. Cl.
*A47L 5/24* (2006.01)

(52) U.S. Cl. ..... 15/344; 15/327.2; 15/353; 15/DIG. 1; 15/DIG. 8; 55/337; 55/DIG. 3

(58) Field of Classification Search ..... 15/327.2, 15/344, 353, DIG. 1, DIG. 8; 55/337, DIG. 3; *A47L 5/24*

See application file for complete search history.

(56) References Cited

U.S. PATENT DOCUMENTS

| | | | |
|---|---|---|---|
| 4,704,765 | A | 11/1987 | Ataka |
| 5,367,740 | A | 11/1994 | McCray |
| 2002/0189048 | A1 | 12/2002 | Maruyama et al. |
| 2006/0137132 | A1 | 6/2006 | Orubor |

FOREIGN PATENT DOCUMENTS

| | | | |
|---|---|---|---|
| CN | 85201464 | | 2/1986 |
| GB | 2035787 | | 6/1980 |
| JP | 57112745 | * | 7/1982 |
| JP | 2002-17636 | | 1/2002 |
| JP | 3086818 | | 4/2002 |

(Continued)

OTHER PUBLICATIONS

British Search Report completed on Oct. 9, 2006 directed towards foreign patent application GB0614235.0; 1 page.

(Continued)

*Primary Examiner* — David Redding
(74) *Attorney, Agent, or Firm* — Morrison & Foerster LLP

(57) ABSTRACT

A handheld cleaning appliance includes a dirty air inlet, a clean air outlet and separating apparatus for separating dirt and dust from an airflow in an airflow path leading from the air inlet to the air outlet. The cyclonic separator is arranged in a generally upright orientation. A base surface of the main body and a base surface of the cyclonic separator together form a base surface of the appliance for supporting the appliance on a surface. By providing a base surface of the appliance which is made up of the base surface of the main body and the base surface of the cyclonic separator, the appliance is provided with a substantial base surface on which the appliance can be stably and reliably supported. This is also achieved without substantially increasing the size of the appliance as a whole.

9 Claims, 5 Drawing Sheets

FOREIGN PATENT DOCUMENTS

| | | |
|---|---|---|
| JP | 2004-351234 | 12/2004 |
| KR | 1989-0006591 | 9/1989 |
| KR | 2003-0060539 | 7/2003 |

OTHER PUBLICATIONS

British Search Report completed on Jan. 5, 2007 directed towards foreign patent application GB0618492.3; 1 page.

International Search Report and Written Opinion mailed on Sep. 26, 2007 directed towards international application No. PCT/GB2007/002540; 11 pages.

International Preliminary Report on Patentability mailed on Jul. 30, 2008 directed towards international application No. PCT/GB2007/002540; 8 pages.

* cited by examiner

HANDHELD CLEANING APPLIANCE

REFERENCE TO RELATED APPLICATIONS

This application is a national stage application under 35 USC 371 of International Application No. PCT/GB2007/002540, filed Jul. 6, 2007, which claims the priority of United Kingdom Application Nos. 0614235.0 and 0618492.3, filed Jul. 18, 2006, and Sep. 20, 2006, respectively, the contents of which prior applications are incorporated herein by reference.

FIELD OF THE INVENTION

The invention relates to a handheld cleaning appliance particularly, but not exclusively, to a handheld vacuum cleaner. More particularly, the invention relates to a handheld cleaning appliance having a cyclonic separator.

BACKGROUND OF THE INVENTION

Handheld vacuum cleaners are well known and have been manufactured and sold by various manufacturers for several years. Typically, a handheld vacuum cleaner comprises a casing which houses a motor and fan unit for drawing air into the cleaner via an inlet, and a separation device such as a filter or bag for separating dirt and dust from the incoming airflow. An example of such a vacuum cleaner is shown in GB 1207278.

Handheld vacuum cleaners have more recently been developed to incorporate cyclonic separation systems which are capable of removing larger items of debris from the airflow before removing finer particles using a filter or other barrier means. An example of such a device is sold by Black & Decker under the trade name DUSTBUSTER®. These vacuum cleaners are generally elongate in shape with a handle at or near a first end and a dirty air inlet located at the end remote from the handle. The cyclonic separator is therefore commonly arranged generally in a horizontal direction. This can affect the performance of the cyclonic separator or its capacity to collect dirt and dust.

A further example of a handheld vacuum cleaner incorporating a cyclonic separator is shown in GB2035787A. In this arrangement, the cyclonic separator is arranged in an upright configuration and has a base surface on which the appliance can be supported. However, the base surface of the cyclonic separator is relatively small in comparison to the appliance as a whole and the appliance is therefore relatively unstable when balanced on the base surface of the cyclonic separator.

SUMMARY OF THE INVENTION

It is therefore an object of the present invention to provide a handheld cleaning appliance incorporating a cyclonic separator which is oriented in a generally upright configuration for improved capacity and performance, the appliance being more convenient and stable to store on a flat surface.

The invention provides a handheld cleaning appliance comprising a main body, a dirty air inlet, a clean air outlet and a cyclonic separator for separating dirt and dust from an airflow located in an airflow path leading from the air inlet to the air outlet, the cyclonic separator being arranged in a generally upright orientation, wherein a base surface of the main body and a base surface of the cyclonic separator together form a base surface of the appliance for supporting the appliance on a surface.

By providing a base surface of the appliance, which is made up of a base surface of the main body and a base surface of the cyclonic separator, the appliance is provided with a substantial base surface on which the appliance can be stably and reliably supported. This is also achieved without substantially increasing the size of the appliance as a whole.

Preferably, the base surface of the main body and the base surface of the cyclonic separator are each substantially planar. More preferably, the base surface of the main body lies adjacent the base surface of the cyclonic separator. Still more preferably, the base surface of the main body lies in the plane of the base surface of the cyclonic separator.

In a preferred embodiment, the main body includes a motor and/or battery unit arranged above the base surface of the main body. In this arrangement, the centre of gravity of the motor and/or battery unit passes through the base surface of the main body which enhances the stability of the main body when it is supported on the base surface thereof. More preferably, the motor and/or battery unit is arranged immediately above the base surface of the main body for further enhancing the stability of the main body.

It is also preferred that the width of the base surface of the main body is at least one half of the width of the cyclonic separator. This provides further increased stability of the base surface of the appliance.

BRIEF DESCRIPTION OF THE DRAWINGS

An embodiment of the invention will now be described with reference to the accompanying drawings, in which.

DETAILED DESCRIPTION OF THE INVENTION

Figure 1:
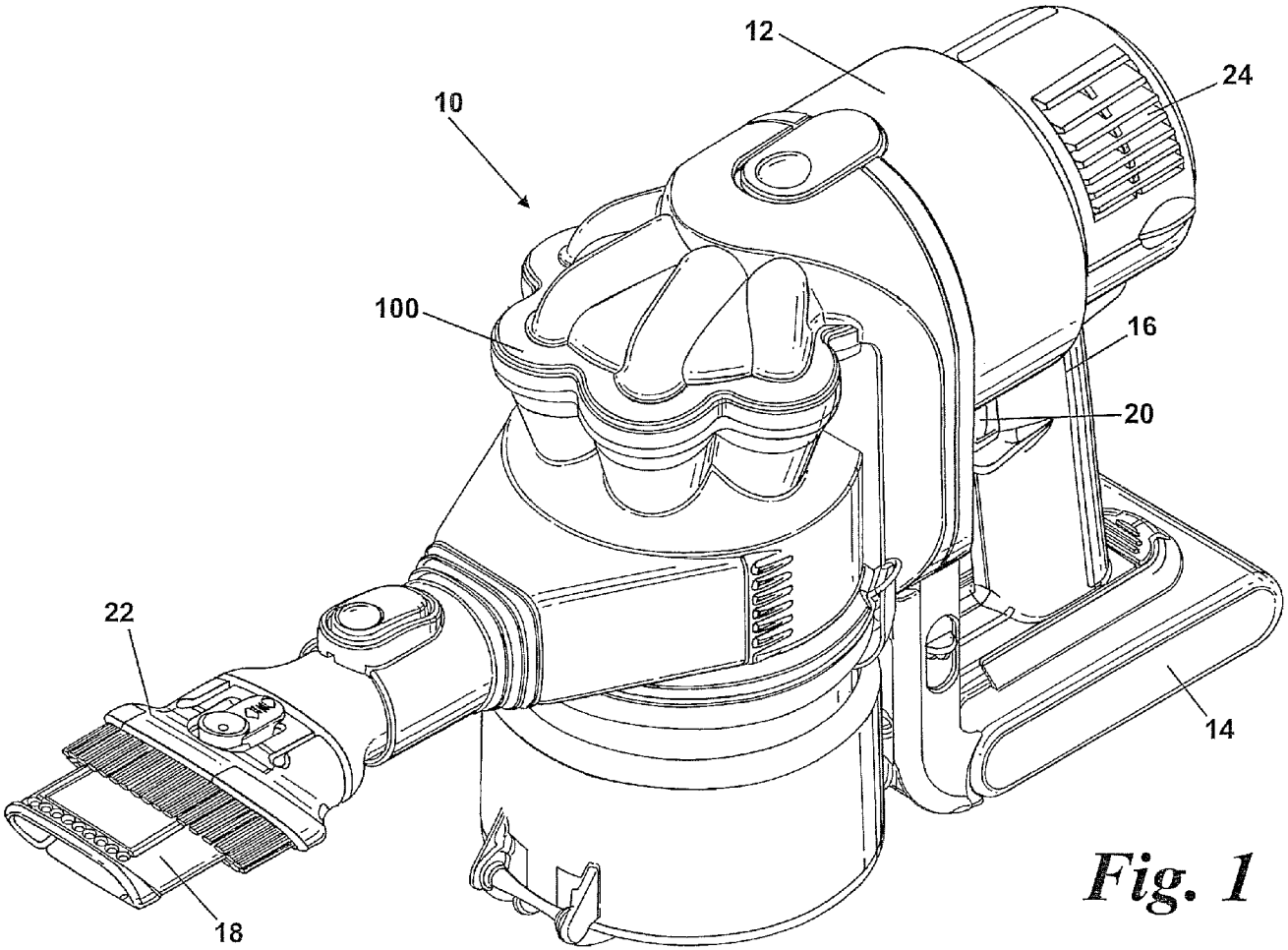
FIG. 1 shows a handheld cleaning appliance according to the invention.
Figure 2:
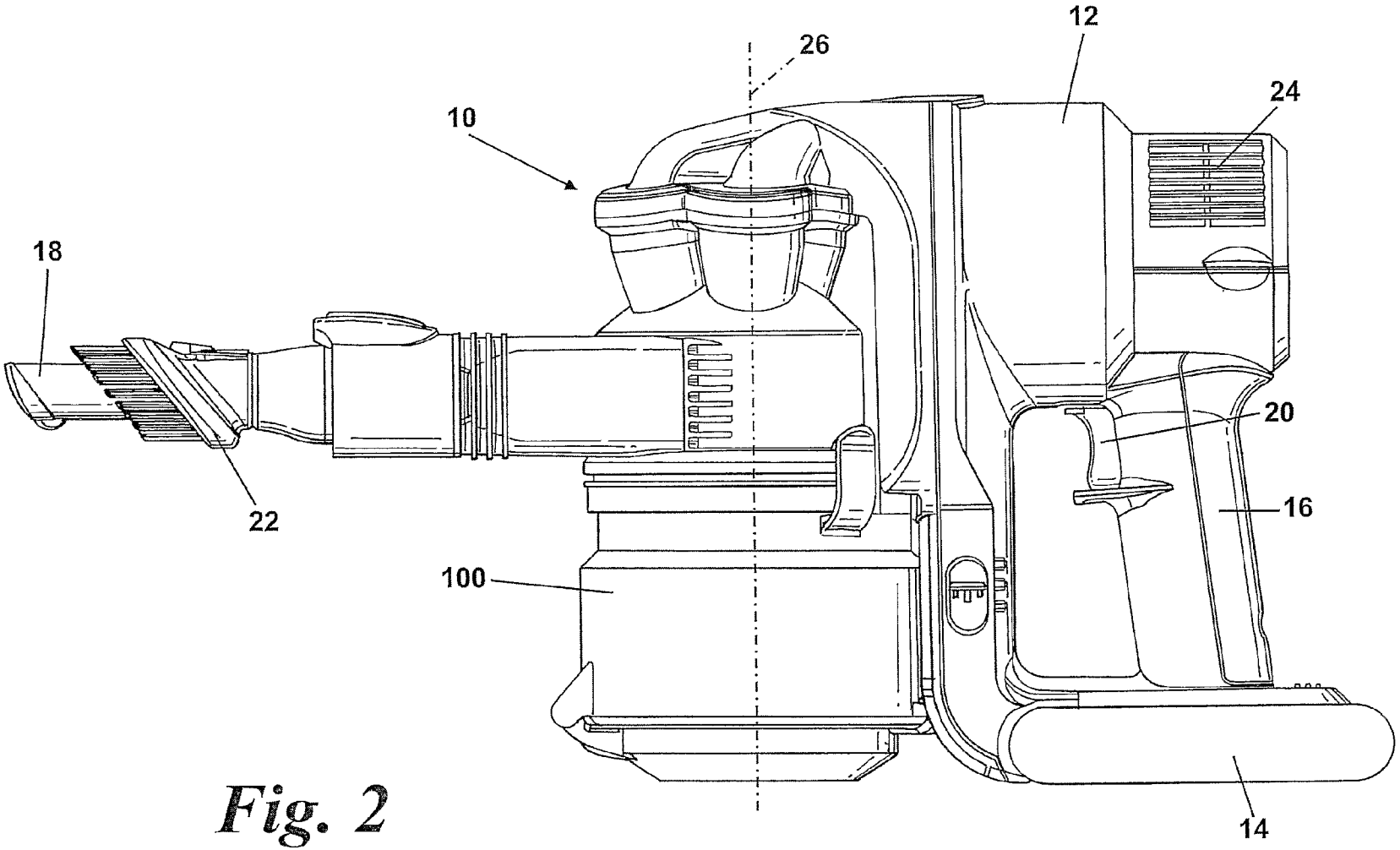
FIG. 2 is a side view of the appliance of FIG. 1.

FIGS. 1 and 2 show a handheld vacuum cleaner 10. The handheld vacuum cleaner 10 has a main body 12 which houses a motor and fan unit (not shown). The main body 12 also includes a power source 14 such as a battery. A handle 16 is provided on the main body 12 for manipulating the handheld vacuum cleaner 10 in use. A cyclonic separator 100 is attached to the main body 12. A dirty air inlet 18 extends from a portion of the cyclonic separator 100 remote from the main body 12. A brush tool 22 is slidably mounted on the distal end of the dirty air inlet 18. A set of exhaust vents 24 are provided on the main body 12 for exhausting air from the handheld vacuum cleaner 10.

The cyclonic separator 100 is located between the main body 12 and the dirty air inlet 18. Consequently, the cyclonic separator 100 is located between the handle 16 and the dirty air inlet 18. The cyclonic separator 100 has a longitudinal axis 26 which extends in a generally upright direction so that the axis 26, and therefore the cyclonic separator 100, lies substantially parallel to the direction in which the handle 16 extends.

The orientation of the handle 16 is such that, when the user grips the handle 16, the user's hand forms a fist in a manner similar to that adopted when gripping a saw. This ensures that the user's wrist is not strained more than necessary when manipulating the handheld vacuum cleaner 10 for cleaning purposes. The cyclonic separator 100 is positioned close to the handle 16 which also reduces the moment applied to the user's wrist when the handheld vacuum cleaner 10 is in use. The handle 16 carries an on/off switch 20 in the form of a trigger for turning the vacuum cleaner motor on and off.

Figure 3:
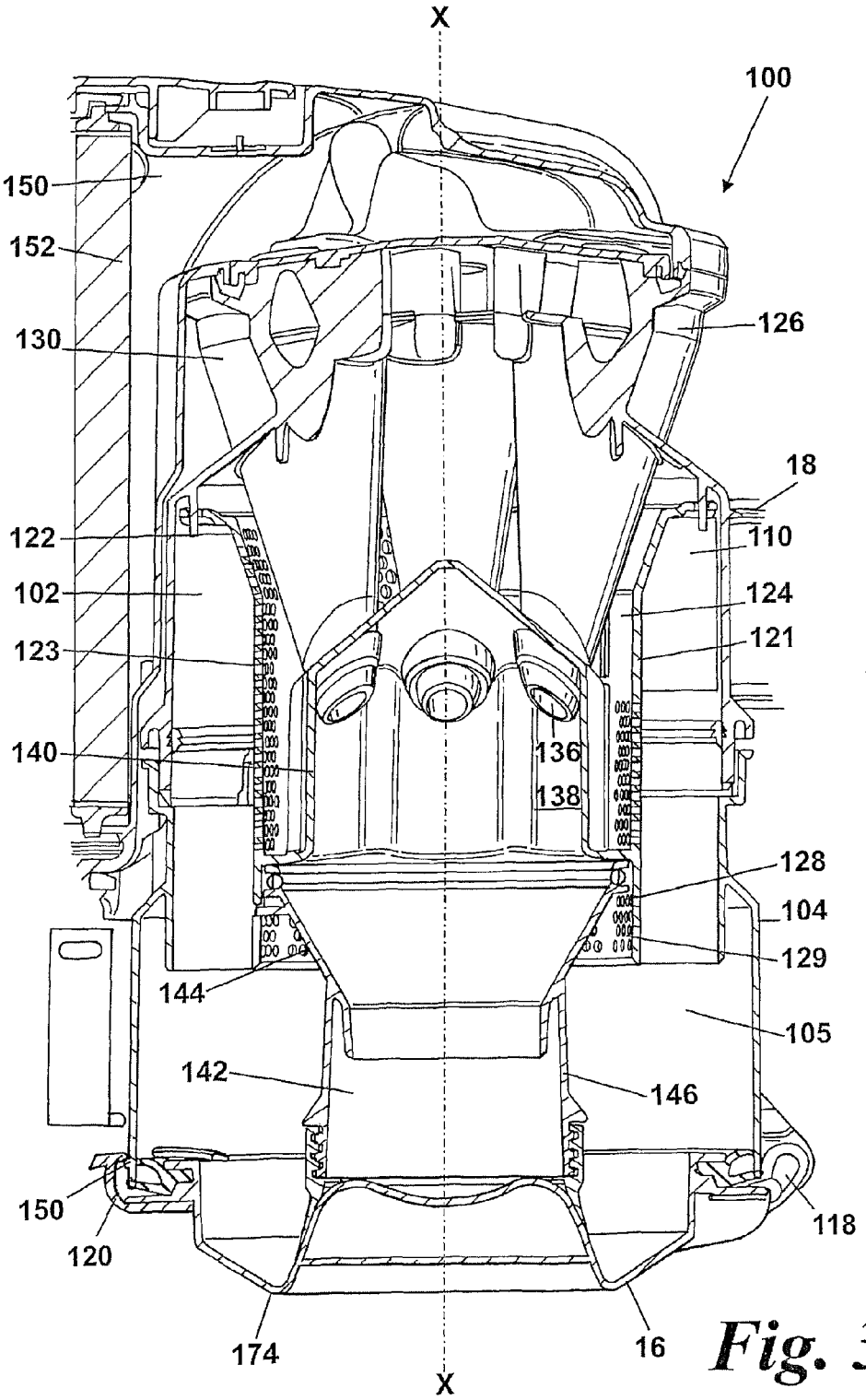
FIG. 3 is a longitudinal cross section through the cyclonic separating apparatus forming part of the appliance of FIG. 1.

The cyclonic separating apparatus 100 forming part of the handheld vacuum cleaner 10 is shown in more detail in FIG. 3. The cyclonic separating apparatus 100 comprises a first cyclone 102 which has a longitudinal axis X-X and a collector 105 having a wall 104. An inlet 110 is formed in the upper portion of the wall 104. The inlet 110 is in communication with the dirty air inlet 18 and forms a communication path between the dirty air inlet 18 and the interior of the first cyclone 102. The air inlet 110 is arranged tangentially to the first cyclone 102 so that the incoming air is forced to follow a helical path around the interior of the first cyclone 102.

A base 116 closes the collector 105 at one end of the first cyclone 102. The base 116 is pivotably mounted on the lower end of the wall 104 by means of a hinge 118. The base 116 is retained in a closed position (as shown FIGS. 1, 2 and 3) by means of a catch 120 which interengages with a lip 150 located on the wall 104. When the catch 120 is released, the base 116 will drop away from the wall 104.

A shroud 121 is located inwardly of the wall 104 of the first cyclone 102. The shroud 121 comprises a part-cylindrical, part-frustoconical wall 122 having a plurality of through-holes 123. The shroud 121 surrounds an outlet 124 from the first cyclone 102. The outlet 124 provides a communication path between the first cyclone 102 and a second cyclone assembly 126. A lip 128 is provided at the base of the shroud 121. The lip 128 has a plurality of through-holes 129 which are designed to allow air to pass through but to capture dirt and dust.

The second cyclone assembly 126 comprises a plurality of second cyclones 130 arranged in parallel with one another. In this embodiment, six second cyclones 130 are provided. The second cyclones 130 are arranged around the axis X-X of the first cyclone 102. The arrangement of the second cyclones 130 is such that the second cyclones 130 are spaced equi-angularly around the axis X-X. Each second cyclone 130 has a tangentially-arranged air inlet and an air outlet (not shown) located at a first end of the respective second cyclone 130. A cone opening 136 is located at a second end of each second cyclone 130. The plane of the cone opening 136 of each second cyclone 130 is inclined with respect to a longitudinal axis (not shown) of the respective further cyclone 130. The cone opening 136 of each of the second cyclones 130 is in communication with a passageway 138 defined by a wall 140 located inwardly of the shroud 121.

A collector 142 is located at the lower end of the passageway 138. The collector 142 comprises a frustoconical first portion 144 and a cylindrical second portion 146. The interior of the collector 142 is delimited by the base 116 and the sides of the first and second portions 144, 146 of the collector 142.

Each of the air outlets of the second cyclones 130 is in communication with a duct 150. The duct 150 provides an airflow path from the cyclonic separating apparatus 100 into other parts of the handheld vacuum cleaner 10. Located at the downstream end of the duct 150 is a pre-motor filter 152. The pre-motor filter 152 comprises a porous material such as foam and can also include a fine filter material. The pre-motor filter 152 is designed to prevent any fine dust particles from entering the motor and causing damage thereto.

In use, when the on/off switch 20 is depressed, the motor and fan unit draws a flow of dirt-laden air into the dirty air inlet 18 and then into the cyclonic separator 100. Dirt-laden air enters the cyclonic separator 100 through the inlet 110. Due to the tangential arrangement of the inlet 110, the airflow is forced to follow a helical path around the interior of the wall 104. Larger dirt and dust particles are separated by cyclonic motion around the wall 104. These particles are then collected at the base 116 of the first cyclone 102.

The partially-cleaned airflow then flows back up the interior of the first cyclone 102 and exits the first cyclone 102 via the through-holes 123 in the shroud 121. Once the airflow has passed through the shroud 121, it enters the outlet 124 and from there is divided between the tangential inlets of each of the second cyclones 130. Each of the second cyclones 130 has a diameter which is smaller than that of the first cyclone 102. Therefore, the second cyclones 130 are able to separate smaller particles of dirt and dust from the partially-cleaned airflow than the first cyclone 102. Separated dirt and dust exits the second cyclones 130 via the cone openings 136. Thereafter, the separated dirt and dust passes down the passageway 138 and into the collector 142. The separated dirt and dust eventually settles at the bottom of the collector 142 on the base 116.

Cleaned air then flows back up the second cyclones 130, exits the second cyclones 130 through the air outlets and enters the duct 150. The cleaned air then passes from the duct 150 sequentially through the pre-motor filter 152, the motor and fan unit, and a post-motor filter before being exhausted from the vacuum cleaner 10 through the air vents 24.

The first cyclone 102 and the collector 142 can be emptied simultaneously by releasing the catch 120 to allow the base 116 to pivot about the hinge 118 so that the separated dirt and dust can fall away from the cyclonic separator 100. By positioning the cleaning appliance 10 above a suitable dirt receptacle such as a dustbin, the dirt and dust collected in the cyclonic separator can be efficiently and reliably emptied. The user may close the cyclonic separator 100 by moving the base 116 back into the closed position shown in FIGS. 1 and 2 by hand.

Figure 4:
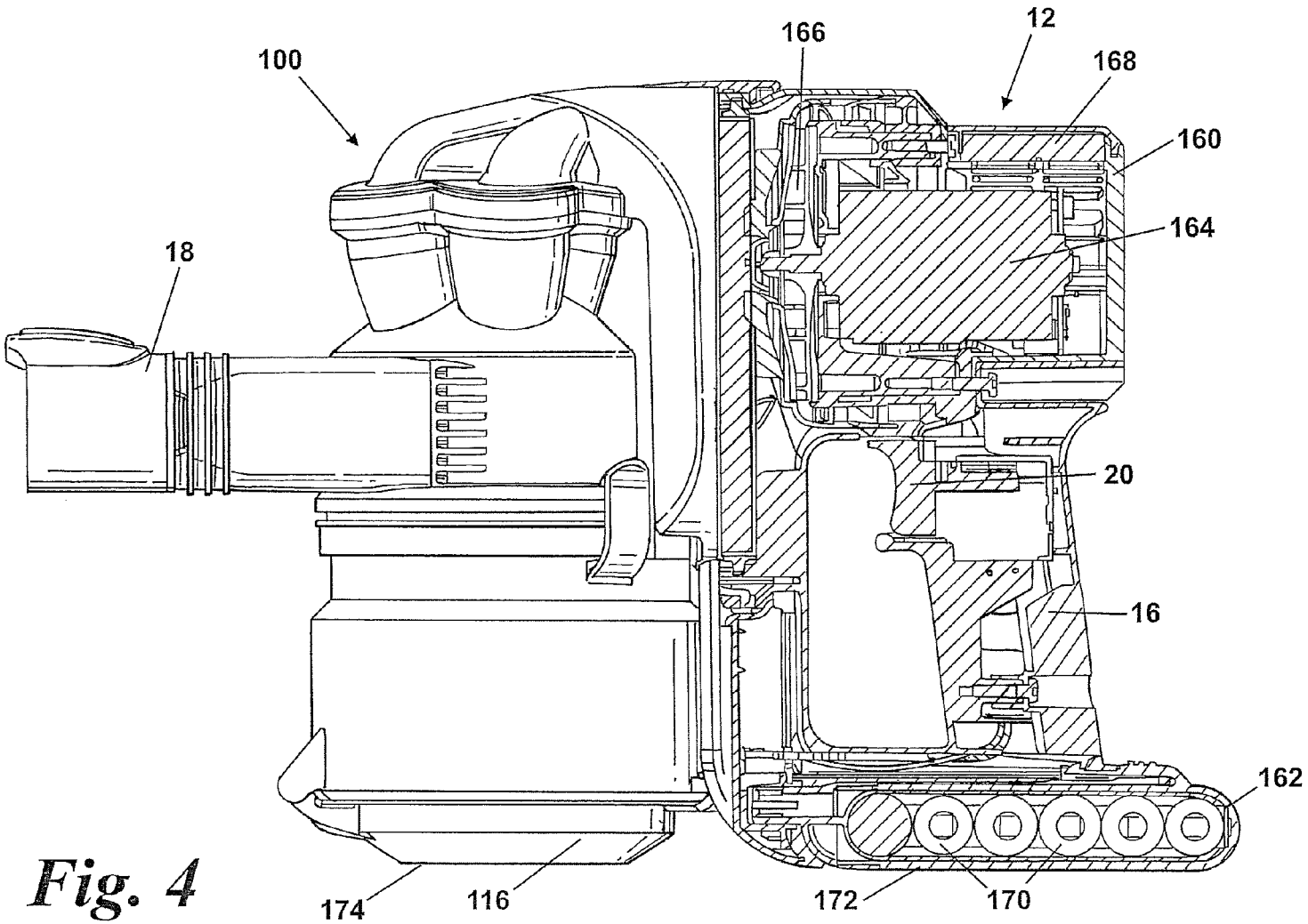
FIG. 4 is a side view similar to FIG. 2 but with the main body shown in section.

FIG. 4 shows the vacuum cleaner 10 in side view with the main body 12 in section. The remainder of the appliance is as shown in FIG. 2 except that the distal end of the dirty air inlet 18 and the brush tool 22 have been omitted. The main body 12 includes the handle 16 (which carries the on/off switch 20), an upper portion 160 and a lower portion 162. The upper portion 160 houses the motor 164 and fan 166 by means of which dirty air is drawn into the appliance when the on/off switch is depressed. A post-motor filter 168 is also provided between the air outlet of the motor and the exhaust vents 24. The lower portion 162 houses a plurality of battery cells 170 for powering the motor 164 when the on/off switch 20 is depressed. Suitable connections between the switch 20, the batteries 170 and the motor 164 are provided within the main body 12.

The lower portion 162 is shaped so as to include a base surface 172 which is planar and faces downwardly away from the handle 16 and away from the upper portion 164. The lower portion 162 is also generally rectangular in shape as can be seen from FIG. 1. The base surface 172 of the lower portion 164 forms a base surface of the main body 12. The motor 164 is positioned so that it lies vertically above the base surface 172 and the battery cells 170 are positioned immediately above the base surface 172.

The cyclonic separator 100 also has a base surface 174 which is formed by the lowermost extremity of the base 116. This base surface 174 of the cyclonic separator 100 in this embodiment is shaped as an annular ring as can be seen in FIG. 3. The annular ring defines the planar base surface 174. Naturally, the base 116 could have been shaped so that the area inside the annular ring forming the base surface 174 was planar but this makes no difference to the invention.

As can be seen in FIG. 4, the base surface 172 of the main body 12 and the base surface 174 of the cyclonic separator 100 lie in the same plane. Together they comprise a base surface of the handheld vacuum cleaner 10. The base surface 172 of the main body 12 lies adjacent the base surface 174 of the cyclonic separator 100 as can also be seen in FIG. 4.

The base surface of the handheld vacuum cleaner 10 provides the vacuum cleaner 10 with a surface on which the appliance can be placed at intervals between periods of use or for storage. Because the base surface extends beyond the area of one or the other of the base surface 172 and the base surface 174, the base surface provided for the entire machine is more stable than would otherwise be the case. This is important because the handheld cleaning appliance 10 has a height which exceeds that of many known handheld vacuum cleaners due to the upright configuration of the cyclonic separator 100.

The positioning of one or the other of the motor 164 and the battery cells 170 vertically above the base surface 172 of the main body 12 enhances the stability of the handheld vacuum cleaner 10 when it is placed on the base surface. This is because the centre of gravity of the motor 164 and/or the battery cells 170, which are relatively heavy components of the handheld vacuum cleaner 10, passes through the base surface 172 of the main body.

Figure 5:
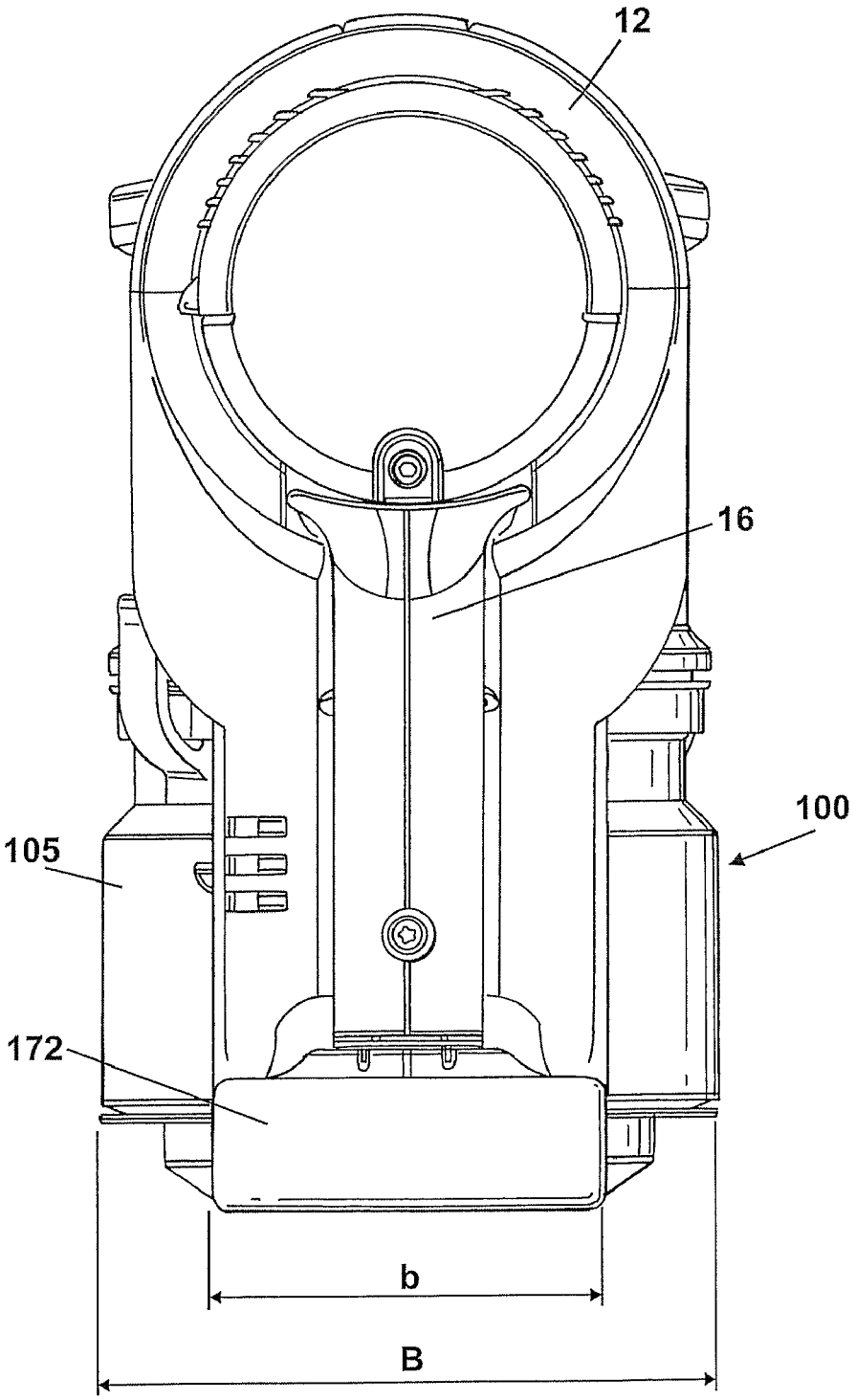
FIG. 5 is a rear view of the appliance of FIG. 1.

The rectangular shape of the lower portion 162 also assists in enhancing the stability of the vacuum cleaner when it is supported on the base surface formed by the base surface 172 of the main body 12 and the base surface 174 of the cyclonic separating apparatus 100. This is because an inadvertent knock to the vacuum cleaner 10 need not cause the vacuum cleaner 10 to topple over if the width of the lower portion 162 is sufficiently wide to provide stability. As can be seen in FIG. 5, the width b of the lower portion 172 is approximately two thirds of the width B of the widest part of the cyclonic separator 100, which is the collector 105. The width b of the lower portion 172 can be as little one half of the width B of the cyclonic separator 100 if preferred.

The invention is not limited to the precise details of the embodiment described above. For example, the number of first and second cyclones can be varied, as can the detail of their design, such as their cone angle, axis inclination and cone opening inclination. The shape of the collector and base can be altered, as can the precise location of the hinge and catch and the location of the actuator. The location of the on/off switch may also be varied. What is important is the presence of a base surface on each of the cyclonic separator and the main body which together form a base surface for the handheld vacuum cleaner in a manner which allows the vacuum cleaner to be placed stably on a surface.

The invention claimed is:

1. A handheld cleaning appliance comprising a main body, a dirty air inlet, a clean air outlet and a cyclonic separator for separating dirt and dust from an airflow located in an airflow path leading from the air inlet to the air outlet, the cyclonic separator being arranged in a generally upright orientation, wherein the main body includes a handle in between upper and lower portions of the main body, the upper portion housing a motor and fan unit by which dirty air can be drawn into the vacuum cleaner, the lower portion including a substantially planar base surface of the main body and housing a battery unit for powering the motor, in use, wherein the substantially planar base surface of the main body and a substantially planar base surface of the cyclonic separator together form a base surface of the appliance for supporting the appliance on a surface, wherein the base surface of the main body lies in the plane of the base surface of the cyclonic separator, and wherein the handle, the motor and fan unit and the battery unit are arranged above the base surface of the main body.

2. The handheld cleaning appliance of claim 1, wherein the base surface of the main body lies adjacent the base surface of the cyclonic separator.

3. The handheld cleaning appliance of claim 1, wherein the battery unit is arranged immediately above the base surface of the main body.

4. The handheld cleaning appliance of claim 1, wherein the base surface of the main body is substantially rectangular in shape.

5. The handheld cleaning appliance of claim 1, wherein the width of the base surface of the main body is at least one half of the width of the cyclonic separator.

6. A handheld cleaning appliance comprising a main body, a dirty air inlet, a clean air outlet and a cyclonic separator for separating dirt and dust from an airflow located in an airflow path leading from the air inlet to the air outlet, the cyclonic separator being arranged in a generally upright orientation, wherein the main body includes a handle in between upper and lower portions of the main body, the upper portion housing a motor and fan unit by which dirty air can be drawn into the vacuum cleaner, the lower portion including a substantially planar base surface of the main body and housing a power source for powering the motor, in use, wherein the substantially planar base surface of the main body and a substantially planar base surface of the cyclonic separator together form a base surface of the appliance for supporting the appliance on a surface, wherein the base surface of the main body lies in the plane of the base surface of the cyclonic separator, and wherein the handle, the motor and fan unit and the power source are arranged above the base surface of the main body.

7. The handheld cleaning appliance of claim 6, wherein the base surface of the main body lies adjacent the base surface of the cyclonic separator.

8. The handheld cleaning appliance of claim 6, wherein the base surface of the main body is substantially rectangular in shape.

9. The handheld cleaning appliance of claim 6, wherein the width of the base surface of the main body is at least one half of the width of the cyclonic separator.

* * * * *